US008256440B2

(12) United States Patent
Della Gaspera et al.

(10) Patent No.: US 8,256,440 B2
(45) Date of Patent: Sep. 4, 2012

(54) DISHWASHER WITH PUMP DRIVEN BY SUPPLY WATER

(75) Inventors: Bruno Della Gaspera, St. Vigil Enneberg Bozen (IT); Matteo Rovetta, Castenedolo (IT)

(73) Assignee: Stoviclean S.r.l. (IT)

( * ) Notice: Subject to any disclaimer, the term of this patent is extended or adjusted under 35 U.S.C. 154(b) by 621 days.

(21) Appl. No.: 12/524,818

(22) PCT Filed: Dec. 28, 2007

(86) PCT No.: PCT/EP2007/064634

§ 371 (c)(1),
(2), (4) Date: Jul. 28, 2009

(87) PCT Pub. No.: WO2008/092541

PCT Pub. Date: Aug. 7, 2008

(65) Prior Publication Data

US 2010/0024848 A1 Feb. 4, 2010

(30) Foreign Application Priority Data

Feb. 1, 2007 (EP) ..... 07002228

(51) Int. Cl.
*A47L 15/42* (2006.01)

(52) U.S. Cl. ..... 134/184; 134/194; 134/34

(58) Field of Classification Search ..... 134/56 D, 134/94.1, 95.3, 103.2, 173, 194, 198, 34, 134/184; 137/565.01, 565.19, 387
See application file for complete search history.

(56) References Cited

U.S. PATENT DOCUMENTS 2,076,688 A * 4/1937 West ..... 4/626
4,542,756 A 9/1985 Gibson

FOREIGN PATENT DOCUMENTS

WO WO-2006/030472 A1 3/2006
WO WO-2008/092541 A1 8/2008

OTHER PUBLICATIONS

"European Application Serial No. 07002228.0, European Search Report dated Jul. 23, 2007", 4 pgs.
"International Application Serial No. PCT/EP2007/064634, International Searh Report mailed Apr. 17, 2008", 3 pgs.
"International Application Serial No. PCT/EP2007/064634, Written Opinion mailed Apr. 17, 2008", 6 pgs.

* cited by examiner

*Primary Examiner* — Michael Kornakov
*Assistant Examiner* — Douglas Lee
(74) *Attorney, Agent, or Firm* — Schwegman Lundberg & Woessner, P.A.

(57) ABSTRACT

Embodiments include a dishwasher to be connected to pressurized supply water is further improved by the dishwasher comprising a pump driven by at least a first part of the supply water, the pump being adapted to produce pressurized washing water for a washing process from a second part of the supply water, wherein the pressurized washing water has a higher pressure than the supply water. Embodiments of the invention provide a dishwasher which achieves a high cleaning effect even at a pressure of the supply water common in the household.

20 Claims, 11 Drawing Sheets

DISHWASHER WITH PUMP DRIVEN BY SUPPLY WATER

RELATED APPLICATIONS

This application is a nationalization under 35 U.S.C. 371 of PCT/EP2007/064634, filed Dec 28, 2007, and published as WO 2008/092541 A1 on Aug. 7, 2008, which claimed priority under U.S.C. 119 to European Patent Application Serial No. 07 002 228.0, filed Feb. 1, 2007, which applications and publication are incorporated herein by reference and made a part hereof.

FIELD OF THE INVENTION

The invention concerns a dishwasher, which is provided, for example, for washing dishes, cutlery, glasses, kitchen utensils and the like. More particularly, the invention concerns a compact cost-effective dishwasher for connecting to pressurized supply water. Such a dishwasher is provided in some embodiments of the invention to be placed in a sink and to be connected to a normal water tap by means of a pipe.

BACKGROUND OF THE INVENTION

WO 2006/030472 A1 shows a dishwasher for connecting to pressurized supply water. In this dishwasher, the supply water is guided to the dishes to be washed through washing nozzles that are arranged at rotatable pipes.

However, the cleaning effect of this dishwasher is suboptimal, especially if the water pressure is low.

U.S. Pat. No. 4,542,756 shows another embodiment of a dishwasher for connecting to pressurized supply water. This dishwasher comprises elastic washing bladders with spray apertures for the washing water. A valve in the supply line periodically stops the water supply and then releases it again. Upon release of the water supply, the washing water flows into the washing bladders, which expand and thereby exercise a wiping movement on the dishes to be washed.

The cleaning effect of this dishwasher is improved by the wiping movement of the washing bladders. However, the washing bladders only reach plane and exposed surfaces, and it is problematic to find a durable and hygienic material for the washing bladders.

SUMMARY OF THE INVENTION

It is therefore an object of the invention to provide a dishwasher which achieves a good cleaning effect even at a supply water pressure common in the household.

The invention provides a dishwasher for connecting to pressurized supply water, the dishwasher comprising a pump driven by at least a first part of the supply water, the pump being adapted to produce pressurized washing water for a washing process from a second part of the supply water, wherein the pressurized washing water has a higher pressure than the supply water. The invention further provides a method having corresponding features. The dependent claims concern optional features of some embodiments of the invention.

The invention is based on the idea to provide a water-driven pump which produces pressurized washing water for a washing process from a part of the supply water. The pressurized washing water has a higher pressure than the supply water. According to the invention, the pump is driven by at least a part of the supply water—i.e., in some embodiments by a part of the supply water and in other embodiments by the entire supply water.

The inventors have recognized that a significantly higher cleaning effect can be achieved by using the pressurized washing water than by simply using washing water having the pressure of the supply water. Surprisingly, this is true even if—as it is the case in many embodiments of the invention—the pressurized washing water is available only during some pressurized washing phases, and the normal washing water used between the pressurized washing phases comprises a lower pressure than the supply water because the supply water pressure has partly been used for driving the pump.

In some embodiments, the dishwasher is devoid of electrical components and/or does not require electrical energy for operation. Such embodiments are particularly cost-effective and merely require a water connection for installation. Further, there is no safety risk as it might possibly exist in connection with electricity.

BRIEF DESCRIPTION OF THE DRAWINGS

Further features, objects and advantages of the invention will become apparent from the following detailed description of several sample embodiments and alternative embodiments of the invention. Reference is made to the drawings, in which.

DETAILED DESCRIPTION OF EMBODIMENTS OF THE INVENTION

Figure 1:
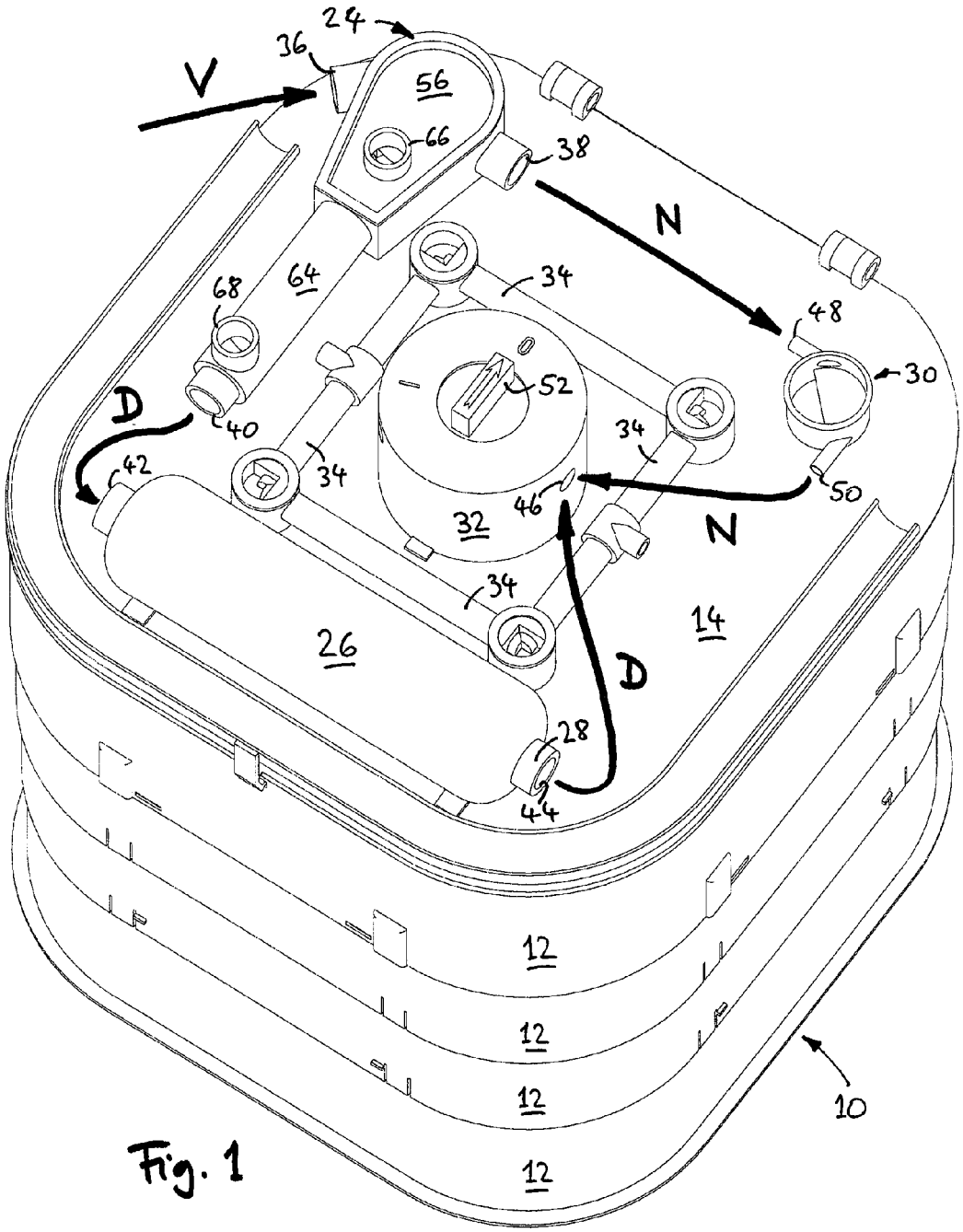
FIG. 1 shows a perspective view of a dishwasher according to a first sample embodiment of the invention.
Figure 2:
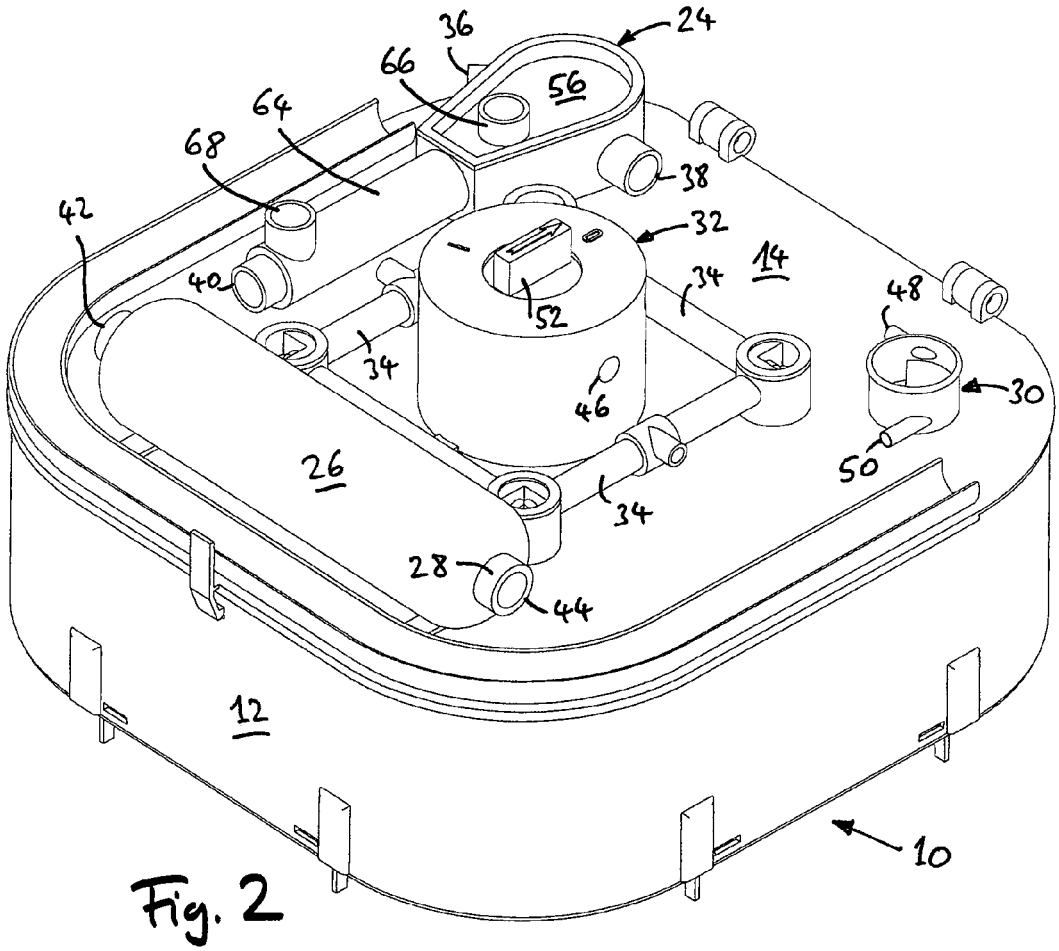
FIG. 2 shows a perspective view of the dishwasher of FIG. 1 in a telescoped housing configuration provided for storing.

The dishwasher shown in FIG. 1 comprises a housing 10 which is open to the bottom and assembled by several outer sections 12 telescopically fittable into each other, a base structure (not shown in FIG. 1) and a cover 14. By telescoping the outer sections 12, the housing 10 can be brought into a flat configuration for storing the dishwasher. This configuration is shown in FIG. 2 and in FIG. 7. In the operational state, the outer sections 12 are in contrast pulled apart, as shown in the other figures. In alternative embodiments, the dishwasher may also be formed as a rigid box—i.e., with non-telescopic sides—or collapsible in another way—i.e., as shown in e.g. WO 2006/030472 A1.

Figure 3:
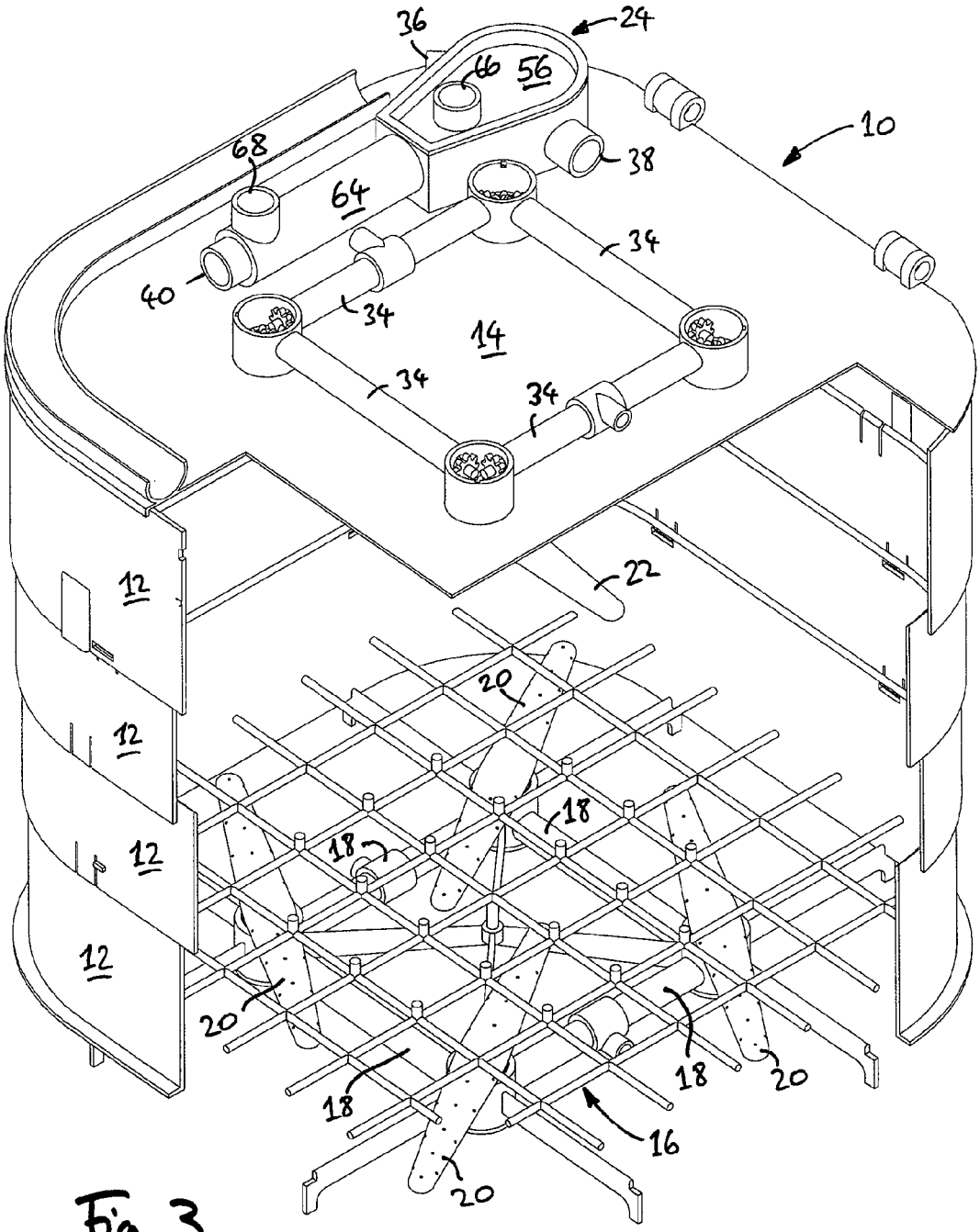
FIG. 3 shows a perspective view of the dishwasher of FIG. 1 in an operational housing configuration with its outer sections partially cut away.
Figure 4:
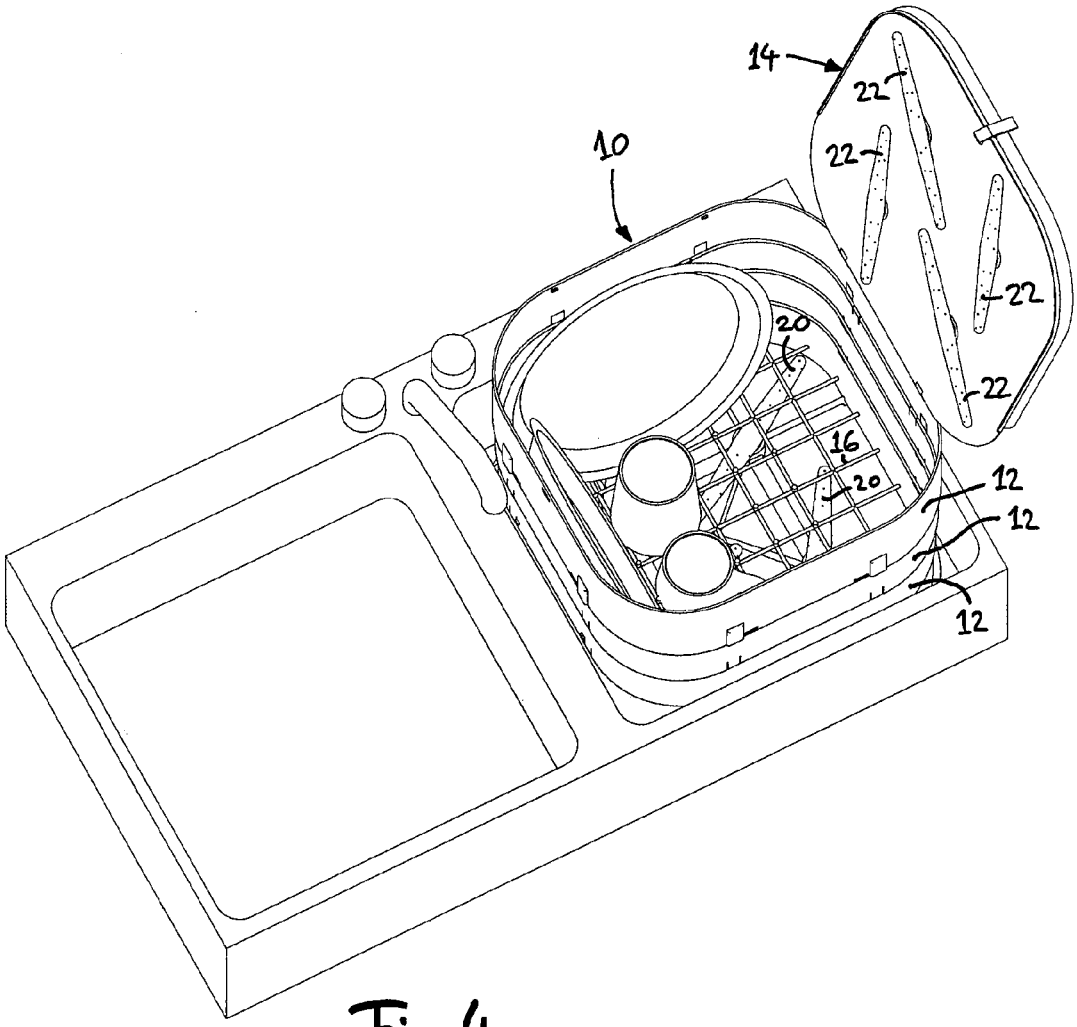
FIG. 4 shows a perspective view of the dishwasher of FIG. 1 placed in a sink and partly loaded.
Figure 5:
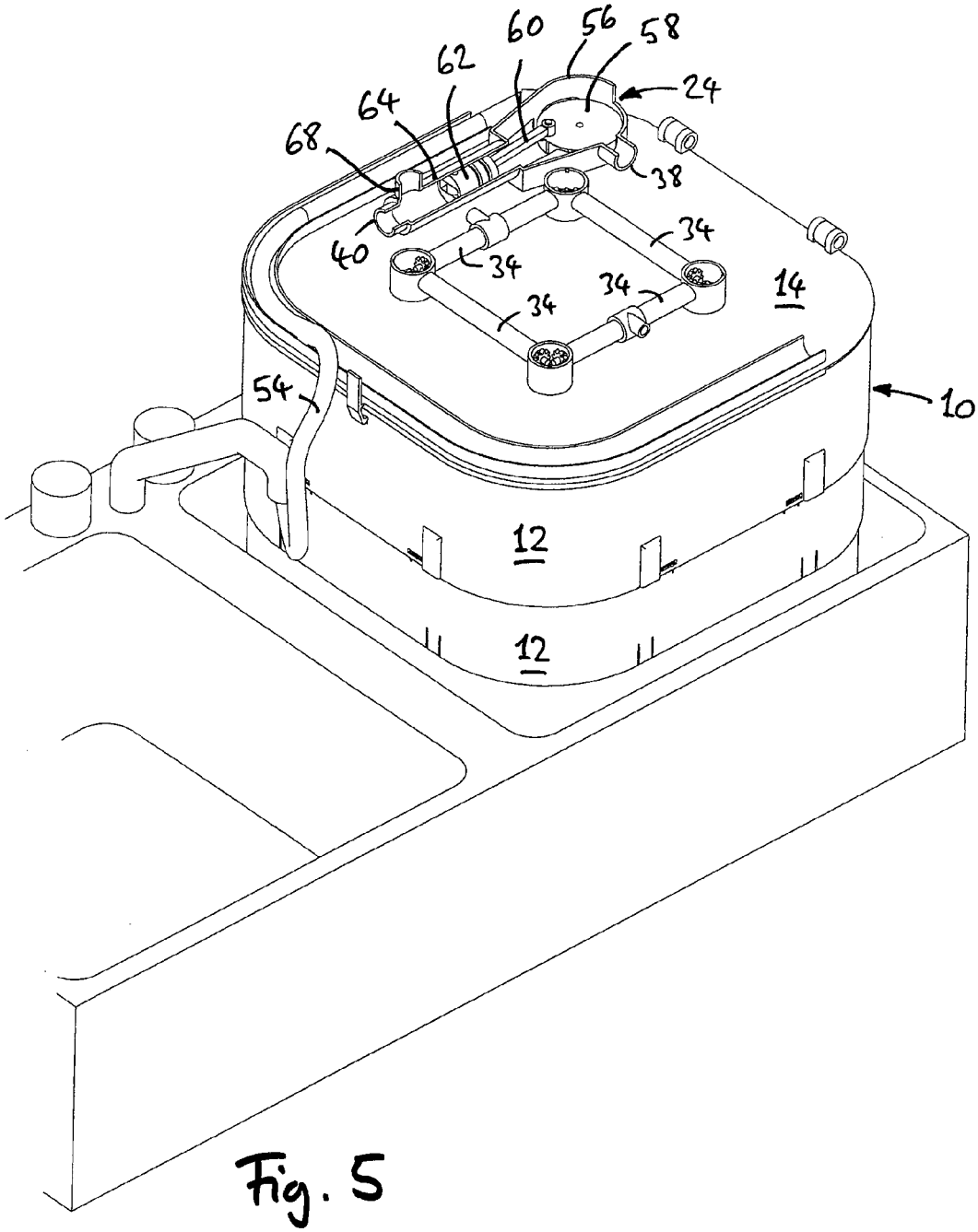
FIG. 5 shows a perspective view of the loaded dishwasher of FIG. 1 connected to a water tap and with a pump housing partially cut away.

The dishwasher is made of suitable plastic materials. In FIG. 3, the outer sections 12 and the cover 14 are illustrated in a partially cut away way, so that in FIG. 3 and partially also in FIG. 4, the grating-like base structure 16 having four rotatable washing nozzle arms 20 connected by washing water pipes 18 is visible. The cover 14 also comprises four rotatable washing nozzle arms 22 on its side facing into the housing 10, which are shown in FIG. 4 and also partially in FIG. 3. It is also apparent from FIG. 4 and FIG. 5, that the dishwasher in the sample embodiment described here is sized such that it can be placed in a conventional sink.

Various mechanical and hydraulic components are arranged on the cover 14 of the dishwasher which are interconnected by means of hose lines. For reasons of clarity, these hose lines are not shown in the figures and are merely indicated in FIG. 1 and in FIG. 6 by bold arrows. FIG. 1 and the other figures show a water-driven pump 24, an expansion vessel 26 with a pressure-controlled valve 28, a dish washing detergent container 30, a timed multiport valve 32 as well as upper washing water pipes 34 for supplying the upper washing nozzle arms 22.

The water-driven pump 24 comprises an inlet 36 for the supply water V, an outlet 38 for normal washing water N and an outlet 40 for pressurized washing water D. The pump 24 is driven by the supply water V. The pump 24 produces the pressurized washing water D from a part of the supply water V such that the pressurized washing water D has a higher pressure than the supply water V. The remaining supply water V is used as normal washing water N comprising a slightly lower pressure than the supply water V.

The expansion vessel 26 comprises an inlet 42 connected to the outlet 40 for the pressurized washing water D. The expansion vessel 26 contains, in a manner known as such, a gas-filled bladder, which is compressed when the filling of the expansion vessel 26 increases, and which provides for the pressure build-up in the expansion vessel 26.

On the outlet side, the pressure-controlled valve 28 is integrated in the expansion vessel 26. The pressure-controlled valve 28 opens at a predetermined overpressure in the expansion vessel 26—for example 2 bar or 3 bar—and allows the pressurized washing water D stored in the expansion vessel 26 to flow out via an outlet 44. The pressure-controlled valve 28 has a characteristic curve with strong hysteresis, so that the expansion vessel 26 empties to a significant extent after the valve 28 has released. All in all, a relatively large amount of pressurized washing water D is thus released in a relatively short time.

The outlet 44 of the pressure-controlled valve 28 is connected to an inlet 46 of the timed multiport valve 32, in order to supply the pressurized washing water D released by the pressure-controlled valve 28 to the timed multiport valve 32. With respect to the normal washing water N, the outlet 38 of the pump 24 is connected to an inlet 48 of the dish washing detergent container 30, and an outlet 50 of the dish washing detergent container 30 is connected to the inlet 46 of the timed multiport valve 32. A dish washing detergent tablet is inserted into the dish washing detergent container 30, and the dish washing detergent tablet is surrounded by the flow of the normal washing water N and thereby is gradually dissolved.

The timed multiport valve 32 comprises several outlets not shown in the figures, which are connected to the upper washing water pipes 34 as well as to the lower washing water pipes 18. A windup grip 52 is also provided, which can be used for setting a timer clockwork (not shown in the figures) integrated in the timed multiport valve 32 in operation.

The timer clockwork integrated in the timed multiport valve 32 controls the washing cycle, wherein the washing water flowing into the inlet 46—consisting of the normal washing water N and the intermittently added pressurized washing water D—is alternately guided in the upper washing water pipes 34 and the washing nozzle arms 22 connected with the latter and in the lower washing water pipes 18 and the washing nozzle arms 20 connected with the latter, respectively. After the washing program has cycled, the timed multiport valve 32 locks the water supply.

The operational mode of the timed multiport valve 32 just described is to be simply understood as an example. The timed multiport valve 32 may comprise, for example, in an alternative embodiment two inlets, in order to separately control the use of the pressurized washing water D and the normal washing water N. Optionally, the pressure-controlled valve 28 can be omitted in this alternative embodiment. Alternatively or additionally, an additional inlet for the supply water V or for the normal washing water N without added dish washing detergent may be provided in the timed multiport valve 32, so that residual dish washing detergent can be removed in a final washing phase. There may also be several different washing programs in some embodiments.

In order to perform a washing process, the dishwasher is placed in a sink, and the cover 14 is removed, as shown in FIG. 4. The dishwasher is then loaded with dishes, the cover 14 is attached, and the inlet 36 for the supply water V is connected to a tap of the sink by means of a hose 54 (see FIG. 5).

The timer clockwork integrated in the timed multiport valve 32 is then wound by turning the windup grip 52 to the position marked as "I" in FIG. 1. The timed multiport valve 32 thereupon releases the water flow, whereby and the lower washing nozzle arms 20 and the upper washing nozzle arms 22 are alternately supplied with washing water, respectively. The washing water flowing out of the washing nozzle arms 20, 22 at a slightly oblique angle moves the washing nozzle arms 20, 22 in a rotational movement and provides for a thorough cleaning of all the dishes located in the dishwasher.

As previously mentioned, the washing water intermittently consists only of the normal washing water N (namely, while the pressure in the expansion vessel 26 builds up and the pressure-controlled valve 28 is closed) and intermittently consists of the normal washing water N in combination with the pressurized washing water D (namely, while the pressure-controlled valve 28 is opened and the expansion vessel 26 is emptying). During the pressurized washing phases, both the washing water pressure and the pressurized washing water flow rate are significantly higher than during the normal washing phases, since the expansion vessel 26 is quickly emptying during the pressurized washing phases. The washing water used flows through the grating-like base structure 16 into the sink.

In the present embodiment, the water-driven pump 24 is constructed as a piston pump. As it is apparent from FIG. 5, the water-driven pump 24 comprises a pump housing 56, in which an impeller 58 is arranged which is acted upon by the supply water V. The impeller 58 moves a piston 62 backwards and forwards in a pump cylinder 64 via an eccentrically attached piston rod 60. The part of the supply water V to be pumped is guided from the pump housing 56 to the pump cylinder 64 via two sockets 66, 68, which are interconnected by means of a hose (not shown). A one-way valve of the pump 24 is provided in each of the socket 68 and the outlet 40.

In the present embodiment, the impeller 58 of the pump 24 is designed as a fan wheel. However, it is to be understood that other embodiments—for example as a turbine impeller—are also possible. In alternative embodiments, the pump 24 may also operate instead as a piston pump according to another pumping principle, for example as a turbine pump.

Figure 6:
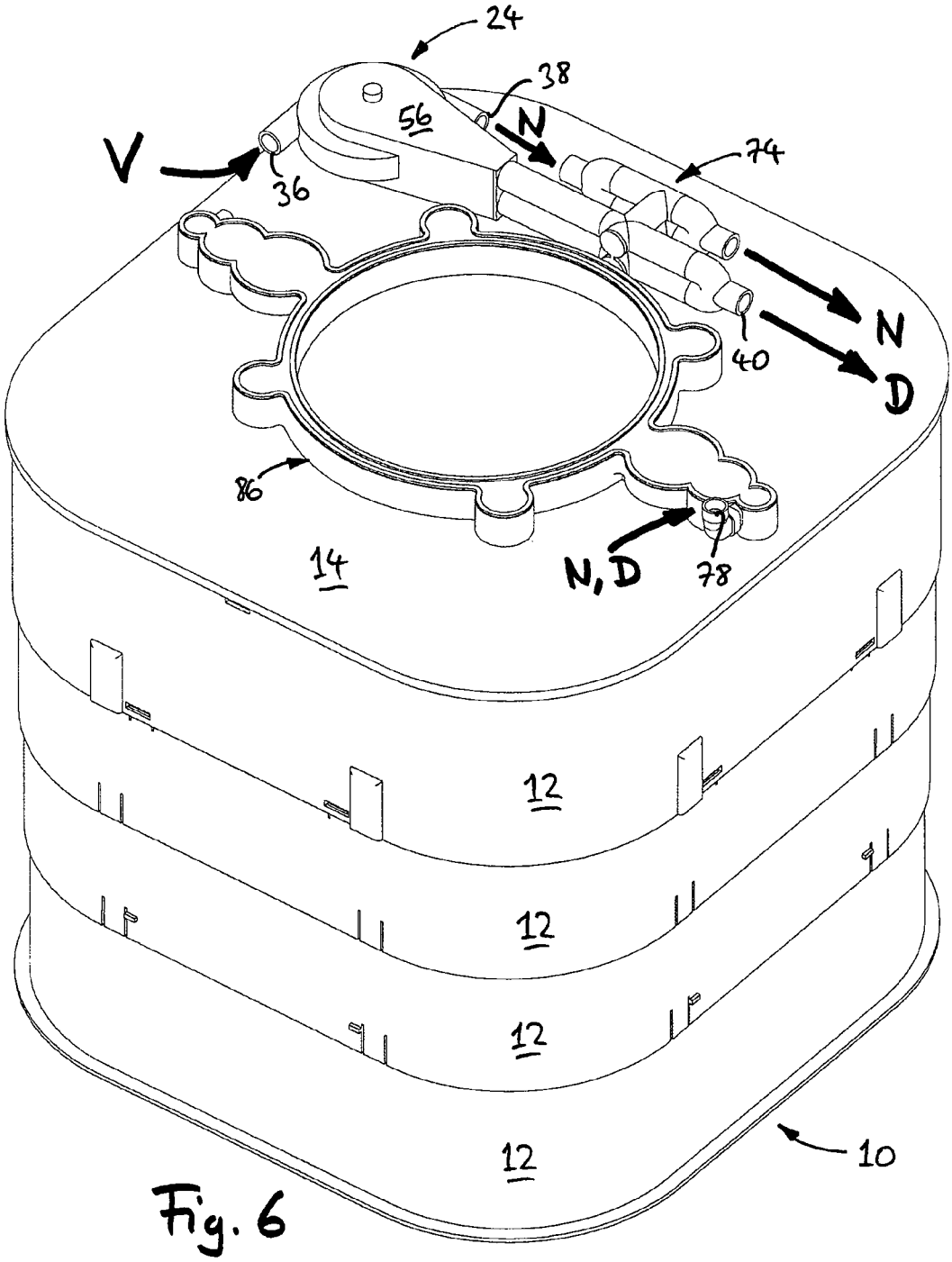
FIG. 6 shows a perspective view of some components of a dishwasher according to a second sample embodiment of the invention in an operational housing configuration.
Figure 7:
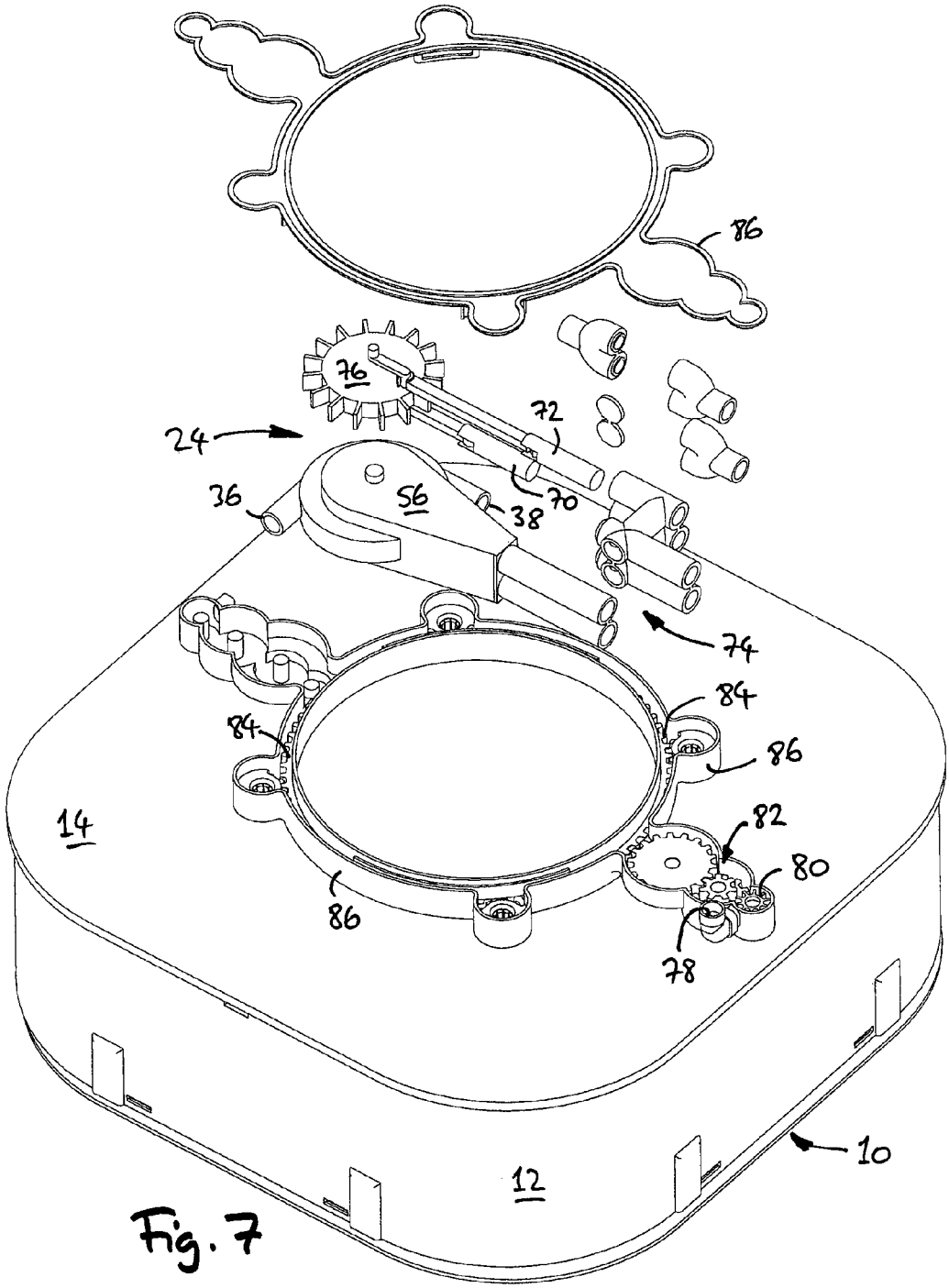
FIG. 7 shows an exploded illustration of the dishwasher of FIG. 6 in a telescoped housing configuration.

FIG. 6 and FIG. 7 show some components of another embodiment of the dishwasher. In this case, the water-driven pump 24 is designed as a piston pump comprising two pistons 70, 72, which move in a combined cylinder and distributor module 74. In this embodiment, a more uniform load is applied to an impeller 76 of the pump 24 which is acted upon by the supply water V.

In the embodiment according to FIG. 6 and FIG. 7, the rotational movement of the washing nozzle arms 20, 22 is further not caused by the recoil of the outflowing washing water, but by a water-driven wheel drive. For this purpose, FIG. 7 shows a washing water inlet 78, which drives a revolving sprocket 84 via a small impeller 80 and a reduction gear 82. The revolving sprocket 84 rotates in a housing 86 and, in doing so, drives the washing nozzle arms 20, 22. The housing 86 is not only used for mounting the sprocket 84, but also for distributing the washing water to the washing nozzle arms 20, 22.

Figure 8:
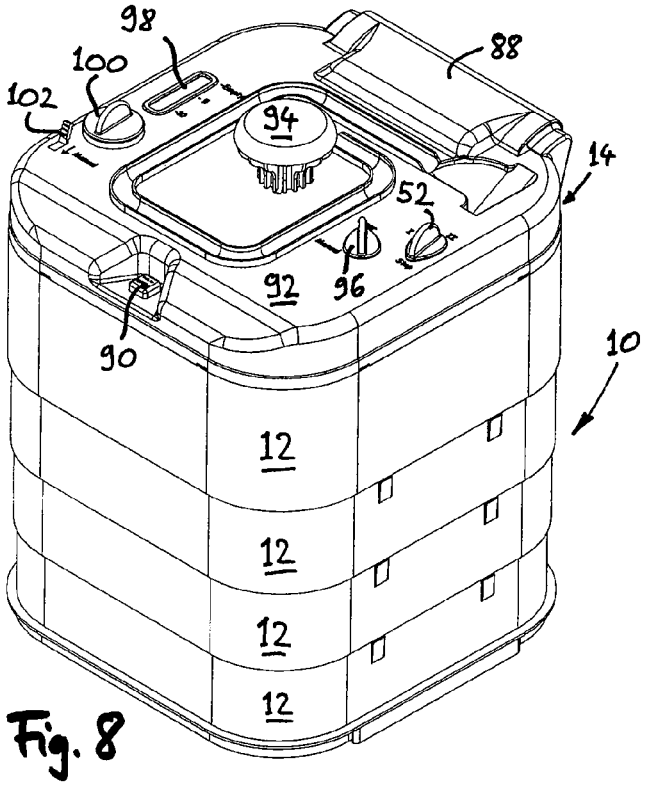
FIG. 8 shows a perspective view of a dishwasher according to a third sample embodiment of the invention.
Figure 9:
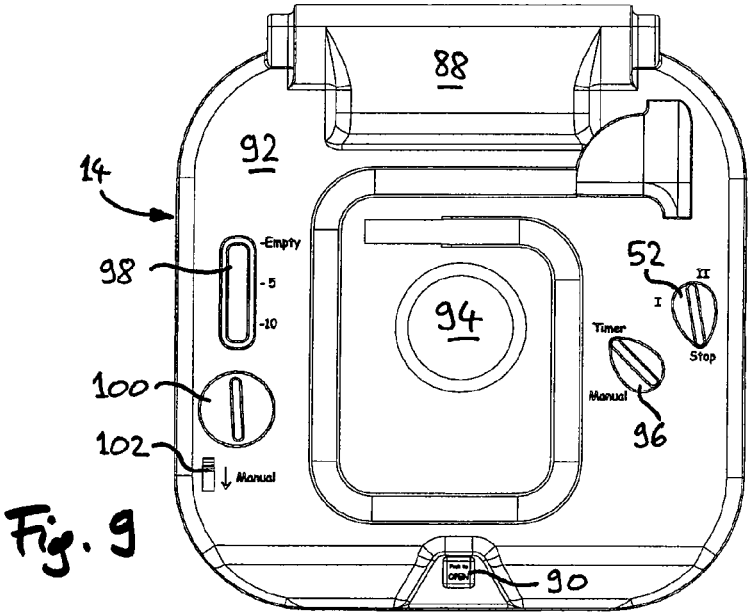
FIG. 9 shows a top view of the dishwasher of FIG. 8, FIG. 10 and FIG. 11 show perspective side views of the cover and interior structure of the dishwasher of FIG. 8.

FIG. 8-FIG. 13 show another embodiment of the dishwasher of the present invention. In FIG. 8 and FIG. 9, a hinge 88 and a lock mechanism operated by a push button 90 serve to attach the cover 14 to the outer section 12 of the housing 10. The cover 14 comprises an outer lid 92 with a central handle 94. A number of operating elements are inserted into the lid 92. These elements include the timer windup grip 52 as well as a manual "on" knob 96, a detergent level indicator 98, a detergent container stopper 100, and a lever 102 for manually operating a detergent pump.

Figure 10:
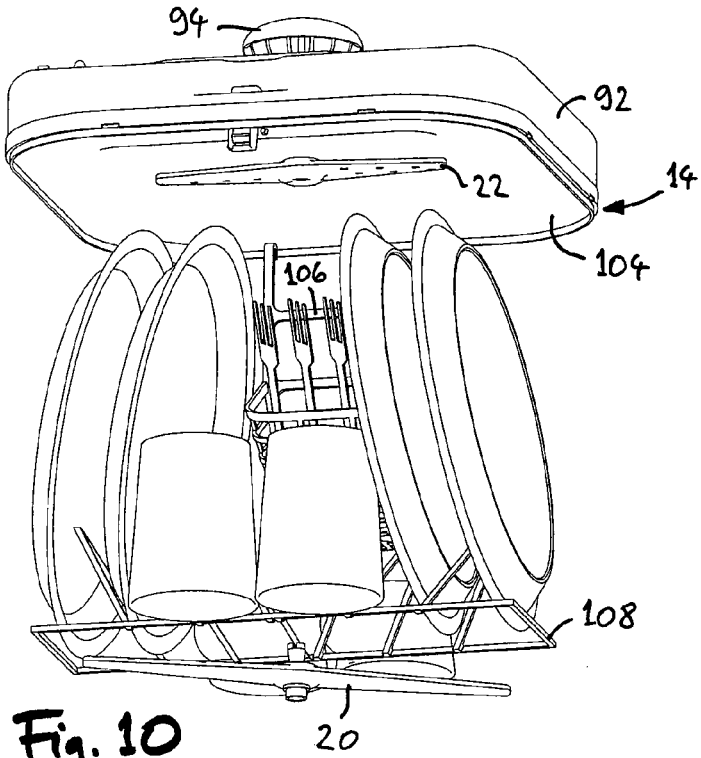
Figure 11:
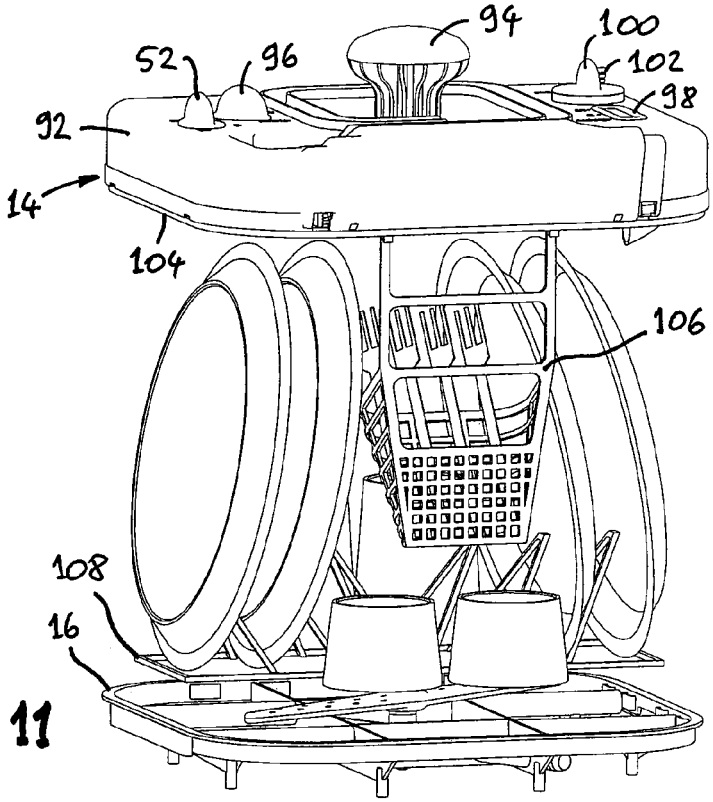

FIG. 10 and FIG. 11 depict the cover 14 with its outer lid 92 and a base plate 104. The dishwasher comprises a basket 106 for holding cutlery and a frame structure 108 for supporting dishes. It is apparent from FIG. 10 that, in the presently described embodiment, there is only a single upper rotatable washing nozzle arm 22 and a single lower rotatable washing nozzle arm 20.

Figure 12:
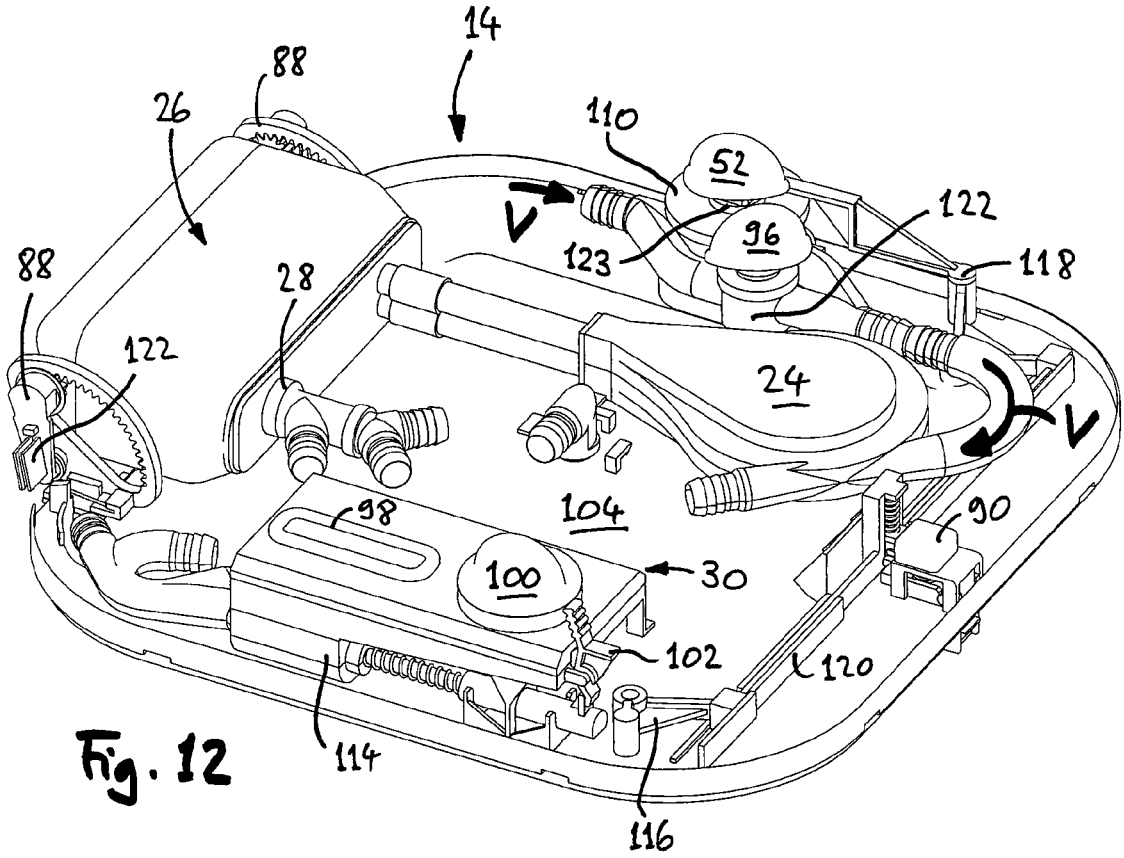
FIG. 12 shows a perspective view of some components of the cover of the dishwasher of FIG. 8.

FIG. 12 shows the various functional elements mounted on the base plate 104 of the cover 14. These elements are similar to the elements already described above in connection with other embodiments of the invention, and consequently the same reference numerals will be used for corresponding elements, even if there are differences in their exact shape and exact operation. The present embodiment, like the embodiments described above, comprises a water driven pump 24 feeding an expansion vessel 26, a pressure-controlled valve 28, and a dish-washing detergent container 30.

A difference between the presently described embodiment and the embodiments described above is that a timed valve 110—which, in the present embodiment, is not a multiport valve—is connected directly to the supply water V. The timed valve 110 comprises a mechanical clockwork mechanism that is operated by the winding grip 52 and can be set to a short washing program with a duration of about 2 minutes (corresponding to position "I" of the winding grip 52 in FIG. 9) and a long washing program with a duration of about 4 minutes (corresponding to position "II" in FIG. 9). Further, there is a bypass valve 112 operated by means of the knob 96. When at least one of the timed valve 110 and the bypass valve 112 is open, the supply water V is connected to the water-operated pump 24.

The detergent container 30 of the presently described embodiment is adapted for use with liquid dishwasher detergent. A detergent pump 114 (FIG. 12), which is configured as a piston pump, is operated either manually by the lever 102 or automatically by the timed valve 110, via two levers 116, 118 and a rod 120. For this purpose, a cam follower 121 (FIG. 13) at the end of the lever 118 follows a cam 123 (FIG. 12) that is integrated with a shaft of the timed valve 110.

Figure 13:
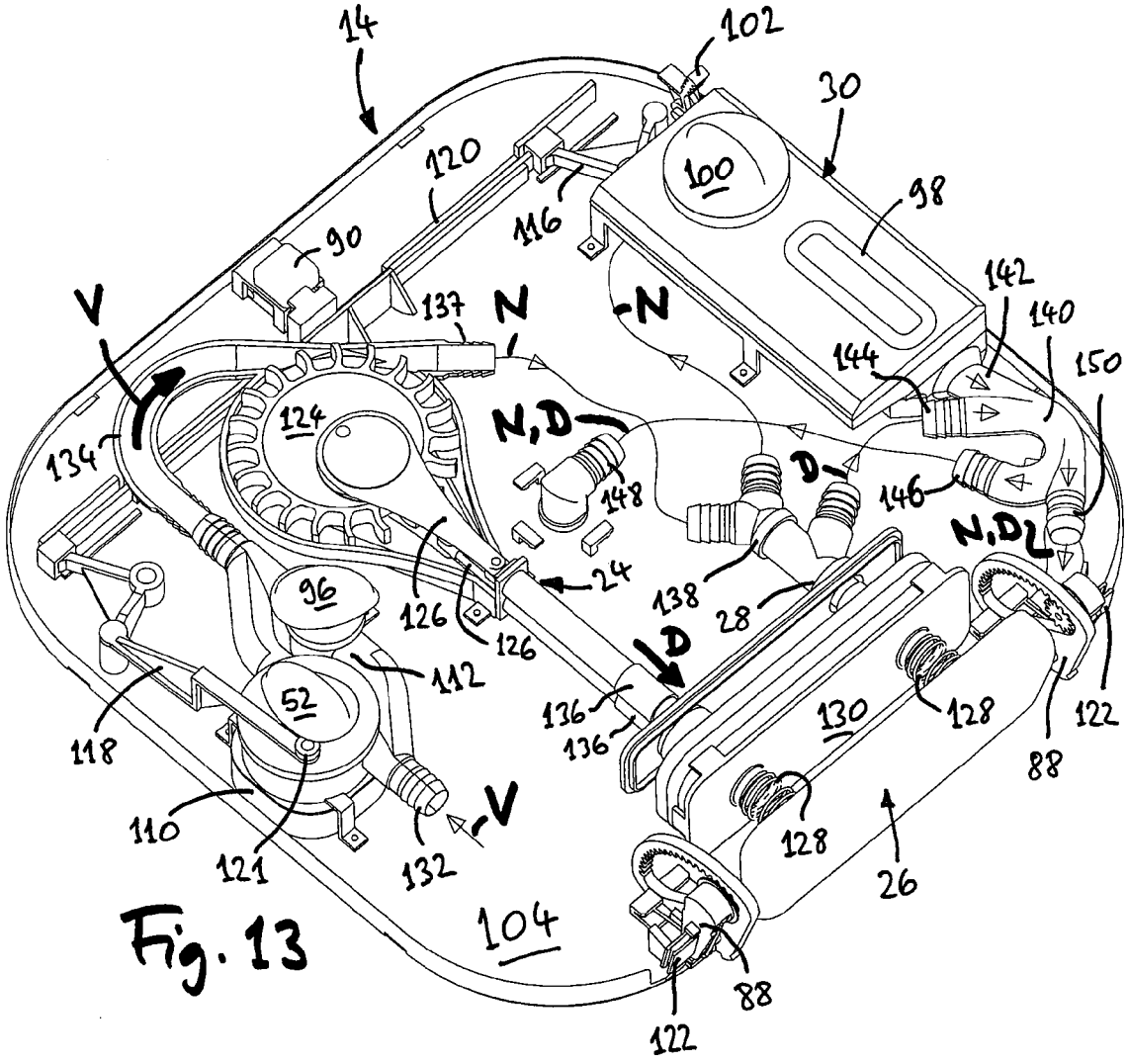
FIG. 13 shows a perspective view similar to FIG. 12 from a different viewing angle with the housings of some components partially cut away.

The upper lid 92 is not shown in FIG. 12 and FIG. 13, but it is apparent that this lid 92 is to be fixed in the slots 122 of the spring-loaded and damped mechanism of the hinge 88.

FIG. 13 shows parts of the internal mechanism of the water-driven pump 24 with an impeller 124 and two eccentrically attached piston rods 126 operating two pistons (not shown) of the pump 24. FIG. 13 further shows parts of the mechanism of the expansion vessel 26 in which two springs 128 attached to a pressure plate 130 provide for a buildup of water pressure within the expansion vessel 26 as the expansion vessel 26 is gradually filled.

As mentioned above, the incoming supply water V is connected directly to an inlet 132 of the timed valve 110 and the bypass valve 112. Whenever at least one of these valves is open, the supply water V is fed through a conduit 134 to the water-driven pump 24. At the pump 24, the supply water V drives the impeller 124 and thus operates the pistons (not shown), which pump pressurized washing water D into the expansion vessel 26 via one-way valves 136. The remaining part of the supply water V leaves the pump 24 as normal washing water N via an outlet 137.

As in the embodiments described above, the pump 24 thus generates the pressurized washing water D (having a higher pressure than the supply water V) from a first part of the supply water V, and the normal washing water N (having a slightly lower pressure than the supply water V) from a second part of the supply water V. The normal washing water N flows via a manifold 138 to the detergent pump 114 (FIG. 12), where it is mixed with liquid detergent whenever the detergent pump 114 is operated.

A distributor 140 receives the normal washing water N with the mixed-in detergent via a first inlet 142 and the pressurized washing water D via a second inlet 144. As mentioned above, the pressurized washing water D is emitted by the pressure controlled valve 28 whenever the pressure in the expansion vessel exceeds a certain limit. The normal washing water N and the intermittently added pressurized washing water D leave the distributor 140 at a first outlet 146, which is connected to an inlet 148 of the upper rotatable washing nozzle arm 22, and a second outlet 150, which is connected to the lower rotatable washing nozzle arm 20.

It is to be understood that the embodiments described here are to be merely considered as examples. Further modifications—especially combinations of the features assigned to the various embodiments here—will be immediately apparent to the person skilled in the art.

What is claimed is:

1. A dishwasher to be connected to a pressurized supply water, comprising:

a pump driven by at least a first part of the supply water, the pump adapted to produce pressurized washing water for a washing process from a second part of the supply water, wherein the pressurized washing water has a higher pressure than the supply water.

2. The dishwasher according to claim 1, wherein the dishwasher further comprises an expansion vessel in which the pressurized washing water is collected.

3. The dishwasher according to claim 2, wherein the dishwasher further comprises a valve controlled by the pressure prevalent in the expansion vessel, the valve adapted to release the pressurized washing water for the washing process upon exceeding a predetermined pressure.

4. The dishwasher according claim 1, wherein the dishwasher is adapted to produce first washing water in at least one first washing phase, wherein the first washing water consists of the pressurized washing water or at least has the pressurized washing water mixed into it, and the dishwasher is adapted to produce second washing water in at least one second washing phase, wherein the second washing water has at most the pressure of the supply water.

5. The dishwasher according to claim 4, wherein the second washing water produced in the at least one second washing phase is normal washing water, which corresponds to the part of the supply water used for driving the pump.

6. The dishwasher according to claim 1, wherein the dishwasher further comprises a timed valve for controlling a washing program.

7. The dishwasher according to claim 1, wherein the dishwasher further comprises at least one rotatable washing nozzle arm, which is driven in a rotational movement by the outflowing washing water.

8. The dishwasher according to claim 1, wherein the dishwasher further comprises at least one rotatable washing nozzle arm, which is driven in a rotational movement by a driving wheel which is acted upon by the washing water.

9. The dishwasher according to claim 1, wherein the pump is a piston pump, which comprises an impeller which is acted upon by at least the first part of the supply water, and at least a piston.

10. The dishwasher according to claim 1, wherein the dishwasher is devoid of electrical elements.

11. The dishwasher according to claim 1, wherein the dishwasher does not require electrical energy for operation.

12. The dishwasher according to claim 1, wherein the dishwasher further comprises:

an expansion vessel, in which the pressurized washing water is collected; and a valve controlled by the pressure prevalent in the expansion vessel, the valve being adapted to release the pressurized washing water for the washing process upon exceeding a predetermined pressure.

13. The dishwasher according claim 12, wherein the dishwasher is adapted to produce first washing water in at least one first washing phase, wherein the first washing water consists of the pressurized washing water or at least has the pressurized washing water mixed into it, and the dishwasher is adapted to produce second washing water in at least one second washing phase, wherein the second washing water has at most the pressure of the supply water.

14. The dishwasher according to claim 13, wherein the second washing water produced in the at least one second washing phase is normal washing water, which corresponds to the part of the supply water used for driving the pump.

15. The dishwasher according to claim 14, wherein the dishwasher further comprises a timed valve for controlling a washing program.

16. The dishwasher according to claim 14, wherein the pump is a piston pump, which comprises an impeller which is acted upon by at least the first part of the supply water, and at least a piston.

17. The dishwasher according to claim 14, wherein the dishwasher is devoid of electrical elements.

18. The dishwasher according to claim 15, wherein the pump is a piston pump, which comprises an impeller which is acted upon by at least the first part of the supply water, and at least a piston.

19. The dishwasher according to claim 18, wherein the dishwasher is devoid of electrical elements.

20. A method for operating a dishwasher, the dishwasher being connected to pressurized supply water and comprising a pump driven by at least a first part of the supply water, the method comprising feeding at least the first part of the supply water to the pump to produce pressurized washing water for a washing process from a second part of the supply water, wherein the pressurized washing water has a higher pressure than the supply water.

* * * * *